US006550525B1

(12) United States Patent
Grisolia

(10) Patent No.: US 6,550,525 B1
(45) Date of Patent: Apr. 22, 2003

(54) SAND-WEIGHTED SHOWER CURTAIN

(76) Inventor: Doreen A. Grisolia, 34 Genesee Dr., Commack, NY (US) 11725-4008

( * ) Notice: Subject to any disclaimer, the term of this patent is extended or adjusted under 35 U.S.C. 154(b) by 0 days.

(21) Appl. No.: 10/036,050

(22) Filed: Jan. 4, 2002

(51) Int. Cl.[7] ..... A47H 1/00

(52) U.S. Cl. ..... 160/349.1; 160/349.2; 160/DIG. 6; 4/608; 4/610

(58) Field of Search ..... 160/330, 349.1, 160/349.2, DIG. 6, 405; 4/607, 608, 609, 610, 558, 560

(56) References Cited

U.S. PATENT DOCUMENTS 3,577,307 A * 5/1971 Baier et al. ..... 161/175
3,590,398 A * 7/1971 Jetter ..... 4/154
3,631,543 A * 1/1972 Laauser ..... 4/149
3,818,970 A * 6/1974 Schmitz et al. ..... 160/349
4,386,676 A * 6/1983 Gadde et al. ..... 181/290
4,550,760 A * 11/1985 Gidge et al. ..... 160/328
4,723,326 A 2/1988 Tarlow et al.
5,097,541 A * 3/1992 Annand ..... 4/558
5,101,522 A 4/1992 Prian
5,345,623 A 9/1994 Dearman
5,421,393 A 6/1995 Wolfe
5,809,589 A 9/1998 Johnson
5,950,255 A * 9/1999 Thompson ..... 4/557
6,178,571 B1 * 1/2001 McAllister ..... 4/613
6,336,232 B1 * 1/2002 Toder ..... 4/608
2001/0039677 A1 * 11/2001 Bryce ..... 4/609
2002/0108724 A1 * 8/2002 Grahn ..... 160/330

* cited by examiner

*Primary Examiner*—Bruce A. Lev
(74) *Attorney, Agent, or Firm*—Donald R. Schoonover

(57) ABSTRACT

A shower curtain has a bottom hem that forms a closed pocket. Sand is contained in the closed pocket and provides weight to the shower curtain so the curtain does not blow away from the side of a tub during a shower.

4 Claims, 1 Drawing Sheet

SAND-WEIGHTED SHOWER CURTAIN

BACKGROUND OF THE INVENTION

1. Field of the Invention

The present invention relates in general to baths and showers, and more particularly to flexible closures for a shower.

2. Discussion of the Related Art

Shower curtains are used to prevent water from a shower from splashing out of the tub.and also to prevent cool air from passing into the tub. Also, shower curtains provide privacy. Shower curtains are generally hung from a curtain rod adjacent to the tub and hang down over a portion of the tub. Shower curtains are generally translucent and are generally waterproof.

While shower curtains provide a valuable advantage to baths, they do have several drawbacks. One drawback is that during a shower, the shower curtain often blows back into the tub. This is generally caused by the air currents associated with the hot water, steam flow, air flow and temperature gradients present in a shower. Whatever the cause, the moving shower curtain can be a nuisance, and can even be dangerous if the bather trips on the curtain.

Therefore, there is a need for a shower curtain that is not likely to blow back into the tub during a shower.

While the art contains examples of shower curtains having weights thereon, these weights are generally metal. Such metal elements may have a tendency to rust and may require special maintenance procedures. This requirement adds to the effort required to care for such shower curtains. Furthermore, some metal weights may be incompatible with the materials used in the tub.

Therefore, there is a need for a shower curtain that has low maintenance requirements.

Furthermore, some presently-available shower curtains use metal elements which are not environmentally friendly. Thus, it may be difficult to dispose of an old shower curtain that has metal elements associated therewith.

Therefore, there is a need for a shower curtain that is environmentally friendly.

Still further, shower curtains with special metal elements may be difficult to manufacture, thereby increasing the cost of the shower curtain either to the seller or to the consumer.

Therefore, there is a need for a shower curtain that can overcome the problems associated with presently-available shower curtains yet which can be manufactured in a cost-effective manner.

Furthermore, some presently-available shower curtains having metal elements are not versatile. That is, these shower curtains do not work with all tubs and tub shapes. Thus, part of a potential market is lost to the seller.

Therefore, there is a need for a shower curtain that is versatile.

PRINCIPAL OBJECTS OF THE INVENTION

It is a main object of the present invention to provide a shower curtain that is not likely to blow back into the tub during a shower.

It is another object of the present invention to provide a shower curtain that has low maintenance requirements.

It is another object of the present invention to provide a shower curtain that is environmentally friendly.

It is another object of the present invention to provide a shower curtain that can overcome the problems associated with presently-available shower curtains yet which can be manufactured in a cost-effective manner.

It is another object of the present invention to provide a shower curtain that is versatile.

SUMMARY OF THE INVENTION

These, and other, objects are achieved by a shower curtain embodying the present invention which has a bottom hem located adjacent to the bottom of the shower curtain in the set-up configuration and has sand encased in that bottom hem.

The sand is environmentally friendly, yet provides a great deal of stability to the shower curtain and prevents gaps forming between the shower curtain and the tub. The sand is versatile and does not require a great deal of maintenance. Since sand is readily available, the overall cost of manufacturing the shower curtain is not significantly increased.

DETAILED DESCRIPTION OF THE INVENTION

Other objects, features and advantages of the invention will become apparent from a consideration of the following detailed description and the accompanying drawings.

The shower curtain of the present invention is weighted so no gaps are formed during use and yet is easy to care for and is environmentally friendly.

Figure 2:
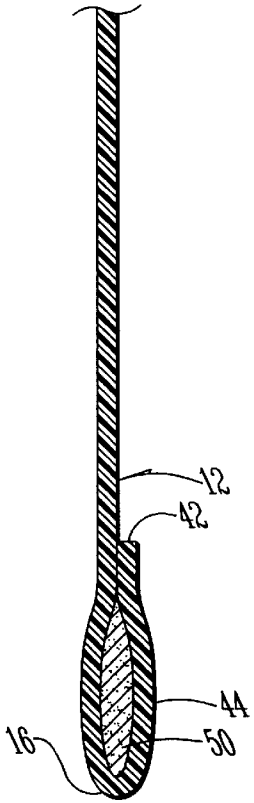
FIG. 2 is a sectional view of the shower curtain embodying the present invention, taken along line 2—2 of FIG. 1.
Figure 1:
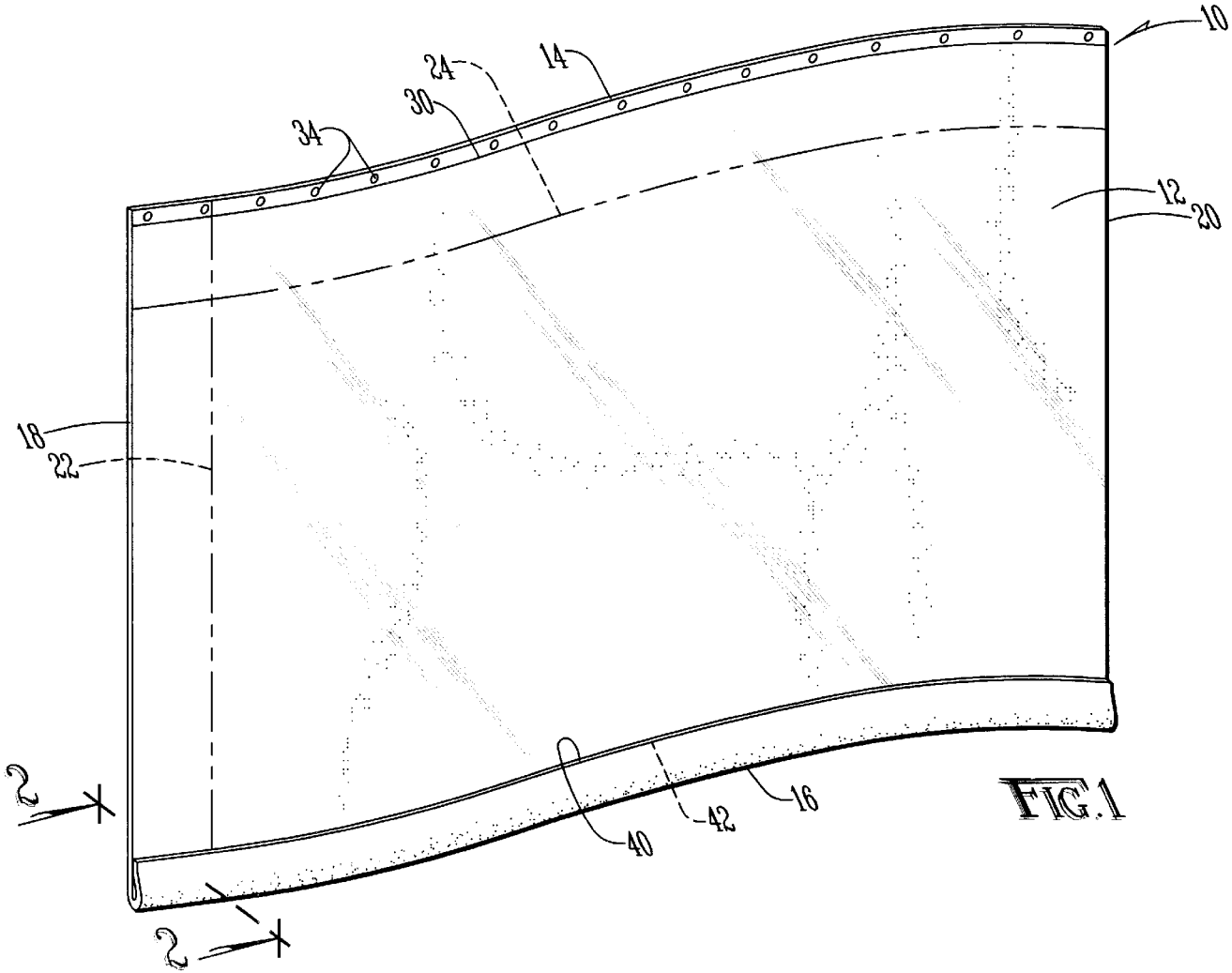
FIG. 1 is a perspective view of a shower curtain embodying the present invention.

A shower curtain 10 embodying the present invention is shown in FIGS. 1 and 2. Shower curtain 10 comprises a flexible body 12, which is constructed of vinyl in one form of the invention and which is translucent and can be formed of various colors. Body 12 includes a top 14 which is attached to a curtain rod in a set-up configuration, a bottom 16 which will be located adjacent to a tub in the set-up configuration and which will abut that tub during use. Body 12 also includes first edge 18 and second edge 20, with a first axis 22 which extends between top 14 and bottom 16 of body 12 as well as a second axis 24 which extends between first edge 18 and second edge 20 of body 12. Body 12 has a length dimension defined between top 14 and bottom 16 along axis 22 and a width dimension defined between edges 18 and 20 along axis 24. The length and width of body 12 are defined according to the size of the tub.

Body 12 further includes a top hem 30 which extends along second axis 24 of body 12 from first edge 18 to second edge 20 of body 12. A plurality of fastener-receiving holes, such as fastener-receiving hole 34, are defined through top hem 30 and through body 12 to receive curtain hooks or the like to hang curtain 10 from a shower curtain rod. The fastener-receiving holes 34 are spaced apart from each other along second axis 24 of body 12. Body 12 further includes a bottom hem 40 which extends along second axis 24 adjacent to bottom 16 of body 12. Hem 40 is doubled back on itself and is attached at a top edge 42 thereof to body 12 and is closed along the first and second edges 18 and 20 of said body 12 and forms a closed pocket, identified by reference number 44 in FIG. 2, which is located adjacent to bottom 16 of body 12. As shown in FIG. 1, top hem 30 is parallel to bottom hem 40 in the set-up configuration.

As shown in FIG. 2, sand 50 is contained in closed pocket 44. Sand 50 weights the bottom of the curtain so the curtain does not blow away from the side of the tub during a shower yet is adaptable to many different tubs and is low maintenance. Furthermore, sand is environmentally friendly so the shower curtain can be discarded when necessary.

In some forms of the invention, body 12 is colored so the curtain can be used in different rooms and sand 50 can also be colored if desired to make the curtain even more versatile.

It is understood that while certain forms of the present invention have been illustrated and described herein, it is not to be limited to the specific forms or arrangements of parts described and shown.

I claim:

1. A shower curtain for a tub comprising:

a) a body, constructed of flexible vinyl, which includes (1) a top, (2) a bottom, (3) first and second edges, (4) a first axis extending between the top and the bottom of said body, (5) a second axis extending between the first and second edges of said body, (6) a top hem extending along the second axis of said body from the first edge to the second edge of said body, (7) a plurality of fastener-receiving holes defined through the top hem and through said body, (8) the fastener-receiving holes being spaced apart from each other along the second axis of said body, (9) a bottom hem exending along the second axis adjacent to the bottom of said body, and

(10) the bottom hem being doubled back on itself and closed along a top edge against said body and being closed along the first and second edges of said body to form a closed pocket located adjacent to the bottom of said body; and b) sand contained in the closed pocket of said body; and c) wherein the bottom of said body is adapted to abut and conform to walls of a tub during use.

2. The shower curtain as described in claim 1 wherein said sand is colored.

3. The shower curtain as described in claim 2 wherein said body is colored.

4. The shower curtain as described in claim 1 wherein the top hem and the bottom hem of said body are parallel with each other.

* * * * *